US006129482A

United States Patent [19]

Ditullio

[11] Patent Number: 6,129,482

[45] Date of Patent: Oct. 10, 2000

[54] REVERSIBLE INTERLOCKING FIELD DRAIN PANEL

[76] Inventor: Robert J. Ditullio, 38 Hidden Brook Dr., Brookfield, Conn. 06804

[21] Appl. No.: 09/183,111

[22] Filed: Oct. 30, 1998

Related U.S. Application Data

[60] Provisional application No. 60/063,896, Oct. 31, 1997.

[51] Int. Cl.[7] ..... E02B 11/00; F16L 9/06

[52] U.S. Cl. ..... 405/43; 405/36; 405/48; 405/49; 138/173

[58] Field of Search ..... 405/36, 43, 44, 405/45, 46, 47, 48, 49, 124, 154; 138/119, 121, 128, 156, 170, 171, 173; 285/325; 210/170, 293

[56] References Cited

U.S. PATENT DOCUMENTS

| | | | |
|---|---|---|---|
| 980,442 | 1/1911 | Schlafly . | |
| 996,708 | 7/1911 | Feldt | 138/173 X |
| 1,040,442 | 10/1912 | Shannon | 138/173 X |
| 1,049,542 | 1/1913 | Smith | 405/49 X |
| 1,071,185 | 8/1913 | Shannon . | |
| 2,259,335 | 10/1941 | Carswell et al. | 405/49 |
| 3,926,222 | 12/1975 | Shroy et al. . | |
| 4,245,924 | 1/1981 | Fouss et al. . | |
| 4,331,542 | 5/1982 | Emrie | 210/293 X |
| 4,523,613 | 6/1985 | Fouss et al. . | |
| 4,598,277 | 7/1986 | Feldman | 405/43 X |
| 4,650,367 | 3/1987 | Dietzler . | |
| 4,995,759 | 2/1991 | Plowman et al. . | |
| 5,087,151 | 2/1992 | DiTullio . | |
| 5,118,419 | 6/1992 | Evans et al. | 210/293 X |
| 5,156,488 | 10/1992 | Nichols | 405/48 |
| 5,407,300 | 4/1995 | Guindon et al. | 405/154 X |
| 5,556,231 | 9/1996 | Sidaway et al. | 405/48 |
| 5,588,778 | 12/1996 | Nicholas et al. | 405/48 |
| 5,720,577 | 2/1998 | Sanders et al. . | |
| 5,820,296 | 10/1998 | Goughnour | 405/43 |
| 5,890,838 | 4/1999 | Moore, Jr. et al. | 405/49 |
| 5,996,635 | 12/1999 | Hegler | 138/121 X |

*Primary Examiner*—David Bagnell
*Assistant Examiner*—Jong-Suk Lee
*Attorney, Agent, or Firm*—Ware, Fressola, Van Der Sluys & Adolphson LLP

[57] ABSTRACT

A first molded polymer field drain panel is made from a moldable polymer sheet material and has an elongated chamber with an arched-shape, a first end, a second end and transverse strengthening ribs protruding outwardly therebetween. The elongated chamber has a smaller transverse strengthening end rib, a transverse strengthening end rib and a smaller transverse strengthening intermediate rib. The smaller transverse strengthening end rib is molded at the first end shaped for being embracingly overlapped by a corresponding transverse strengthening end rib of a corresponding elongated chamber of a second molded polymer field drain panel. The transverse strengthening end rib is molded at the second end for overlapping a corresponding smaller transverse strengthening end rib of the corresponding elongated chamber of the second molded polymer field drain panel. The smaller transverse strengthening intermediate rib is molded between the first end and the second end of the first molded polymer field drain panel for being embracingly overlapped by the corresponding transverse strengthening end rib of the corresponding elongated chamber of the second molded polymer field drain panel upon severing removal of at least the transverse strengthening end rib that is molded at the second end of the first molded polymer field drain panel.

29 Claims, 14 Drawing Sheets

(BASIC CONFIG.)

(CONFIG.2)

(CONFIG.1)

(CONFIG.4)

(CONFIG.3)

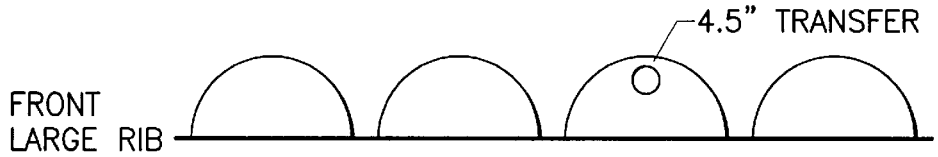
FIG.7
(MODEL "S" STARTER)
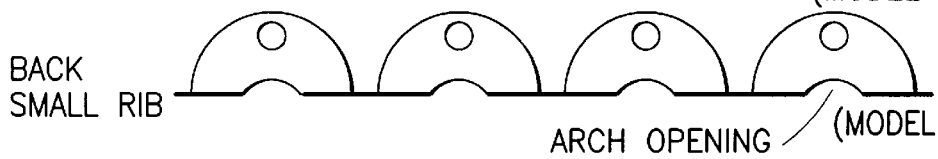
FIG.8
(MODEL "S" STARTER)
FIG.9
(MODEL "I" MIDDLE)
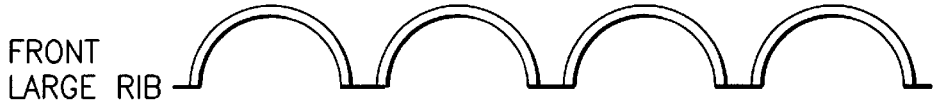
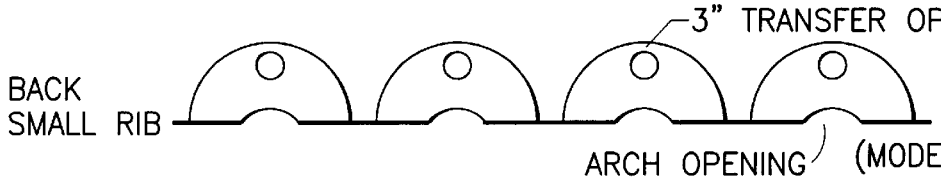
FIG.10
(MODEL "I" MIDDLE)
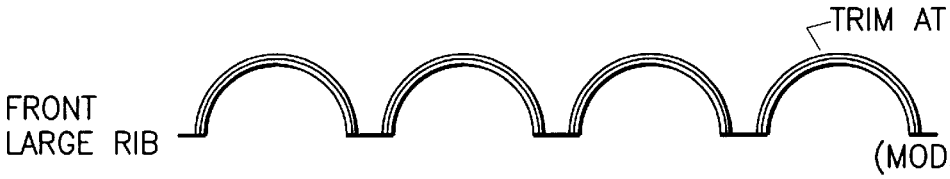
FIG.11
(MODEL "E" END)
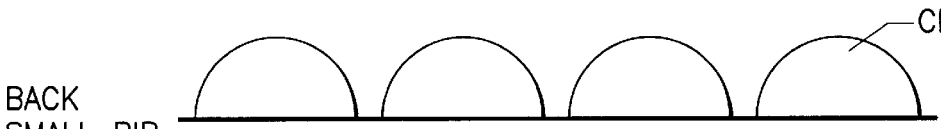
FIG.12
(MODEL "E" END)
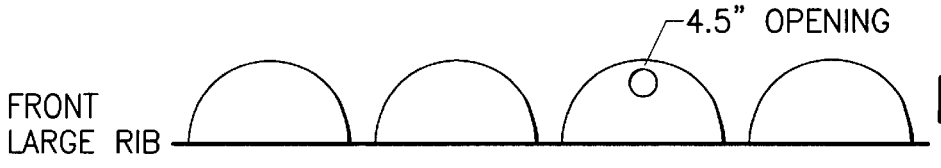
FIG.13
(MODEL "R")
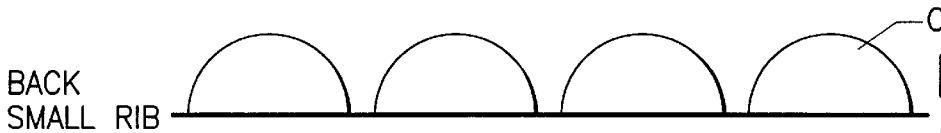
FIG.14
(MODEL "R")

(MODEL "S" STARTER)

(MODEL "S" STARTER)

(MODEL "I" MIDDLE)

(MODEL "I" MIDDLE)

(MODEL "E" END)

(MODEL "E" END)

(MODEL "R")

(MODEL "R" )

(MODEL "S" STARTER)

(MODEL "S" STARTER)

(MODEL "I" MIDDLE)

(MODEL "I" MIDDLE)

(MODEL "E" END)

(MODEL "E" END)

(MODEL "R")

(MODEL "R")

4.5" TRANSFER OPENING
FRONT LARGE RIB (MODEL "S" STARTER)
BACK SMALL RIB (MODEL "S" STARTER)
FRONT LARGE RIB (MODEL "I" MIDDLE)
3" TRANSFER OPENING
BACK SMALL RIB (MODEL "I" MIDDLE)
ARCH OPENING
TRIM AT SMALL RIB
FRONT LARGE RIB (MODEL "E" END)
CLOSED WALL
BACK SMALL RIB (MODEL "E" END)
4.5" OPENING
FRONT LARGE RIB (MODEL "R")
CLOSED WALL
BACK SMALL RIB (MODEL "R")

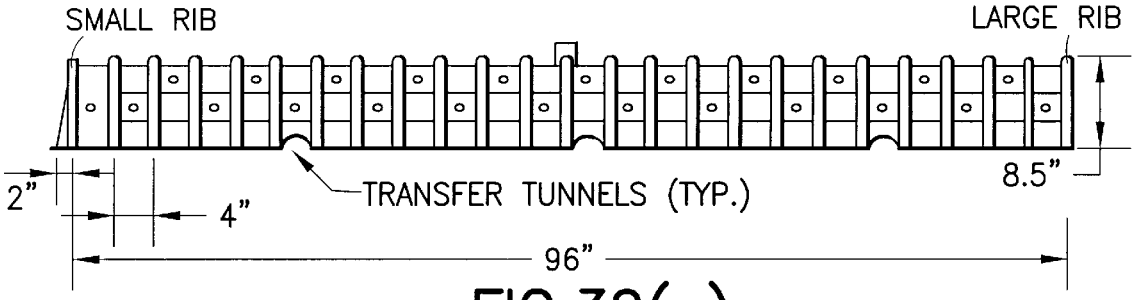
FIG.39(a)
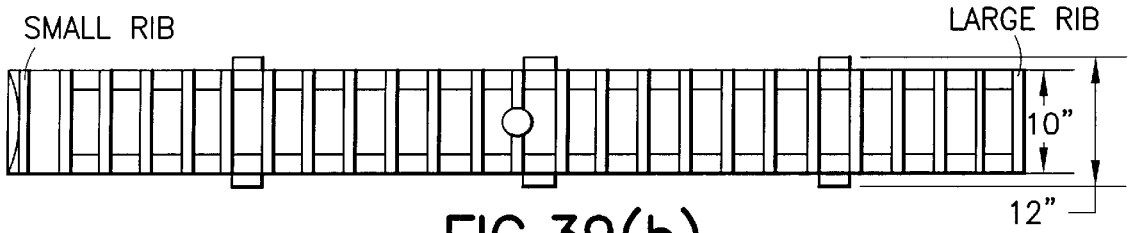
FIG.39(b)
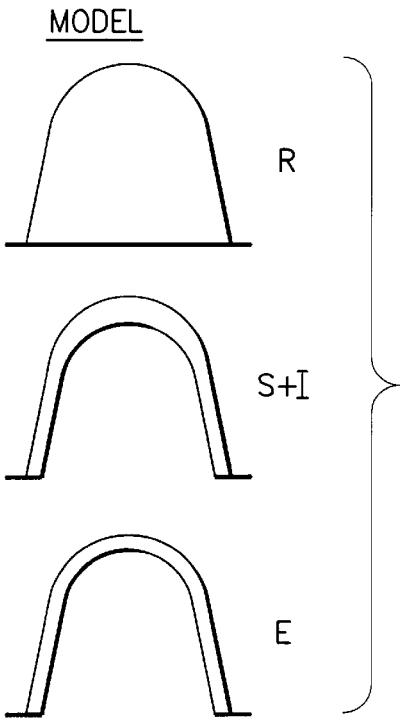
FIG.39(c)
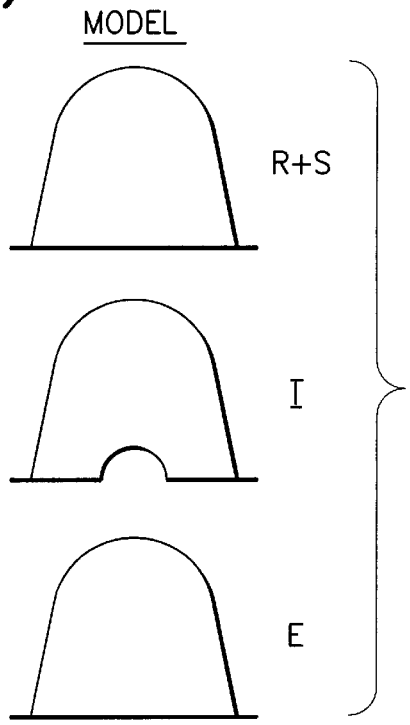
FIG.39(d)
FIG.39

(PAC: PARABOLIC ARCH CONDUIT)

(LOCK DOWN BOTTOM PLATE)

(PAC PARABOLIC ARCH CONDUIT)

(LOCK DOWN BOTTOM PLATE)

(TYPICAL INSTALLATION FOR STREAM CROSSINGS)

VELOCITY=V

V PIPE > V STREAM & V PAC $$\frac{Q\ PAC}{h\ PAC} > \frac{Q\ PIPE}{h\ PIPE}$$

| NO. OF CHANNELS | WIDTH | OVERALL HEIGHT | EFFECTIVE INTERFACE |
|---|---|---|---|
| 1 | 1 foot | 8.5 inches | 2.45 ft2/lf |
| 2 | 2 feet | 8.5 inches | 3.28 ft2/lf |
| 3 | 3 feet | 8.5 inches | 4.11 ft2/lf |
| 4 | 4 feet | 8.5 inches | 4.94 ft2/lf |

FIG.50

COMPARISON OF EFFECTIVE INTERFACE OF FIELD DRAIN® PANEL TO EQUAL WIDTH OF PIPE AND STONE TRENCH:

| FIELD DRAIN® PANEL | | PIPE AND STONE TRENCH | |
|---|---|---|---|
| NO. OF CHANNELS | EFFECTIVE INTERFACE ft2/lf | TRENCH SIZE HEIGHT x WIDTH | EFFECTIVE INTERFACE ft2/lf |
| 1 | 2.45 | 1'x1' | 1.8 |
| 2 *+36% | 3.28 | 1'x2' | 2.4 |
| 3 | 4.11 | 1'x3' | 3.0 |
| 4 | 4.94 | 1'x4' | 3.6 |

FIG.51

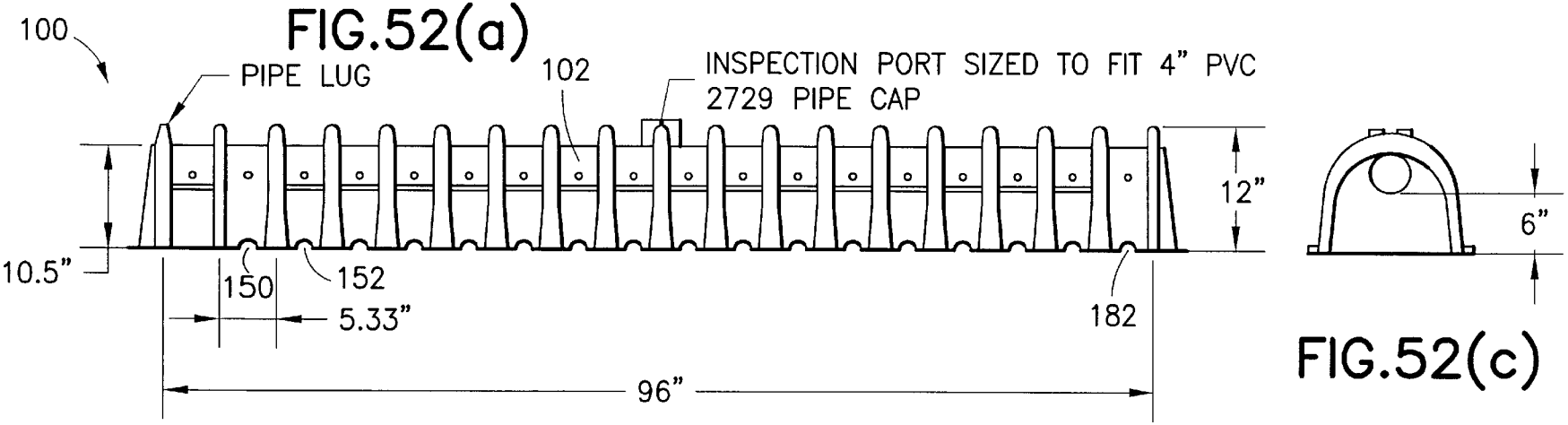
FIG.52(a)
FIG.52(c)
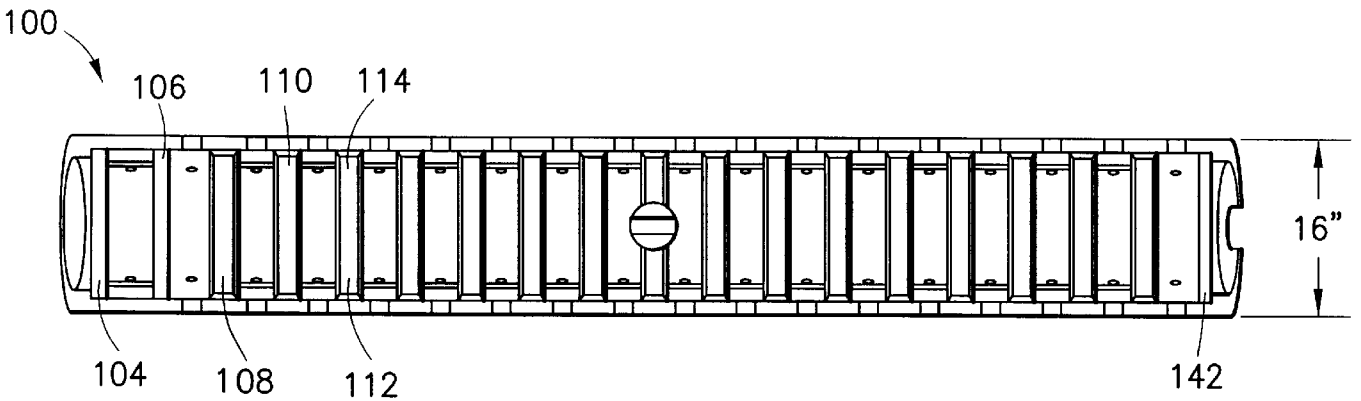
FIG.52(b)
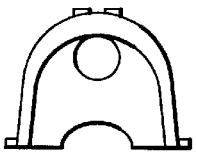
FIG.52(d)
FIG.52

REVERSIBLE INTERLOCKING FIELD DRAIN PANEL

This application claims the benefit of U.S. Provisional application Ser. No. 60/063,896, filed Oct. 31, 1997.

BACKGROUND OF THE INVENTION

1. Field of the Invention

The present invention relates generally to a field drain panel for water management.

2. Description of the Prior Art

A patentability search was conducted on the present invention and the following patents were developed: U.S. Pat. No. 980,442 discloses a drainage culvert which has an upper corrugated arched section 3 and a lower flat section 1 with upturned flanges 2 along each edge. See FIGS. 1 and 3. The culvert may include two upper longitudinal sections as shown in FIGS. 1 and 4 such that the ends overlap one full corrugation. The upper section includes flanges 4 that fit within the upturned flanges 2 of the flat bottom section. Bolts 5 may be used to fasten the sections together.

U.S. Pat. No. 1,071,185 discloses a metal culvert that includes a flat plate 5 with longitudinal grooves 7 for receiving an arched cover plate 6 without the use of fastening means. See FIGS. 1 and 2, and lines 36–46 of page 1. FIG. 3 shows two corrugated arched plates overlapped at their ends so that they interlock. See lines 61–70 of page 2.

U.S. Pat. No. 3,926,222 discloses coupling means on corrugated tubing that includes corrugations of a reduced depth at 12*a* where two tubes are coupled together as compared to the corrugation depths 12 at other sections. See FIGS. 1–3 and column 2, lines 34–41.

U.S. Pat. No. 4,245,924 discloses an arched conduit suitable for use as drain tubing. The conduit includes a flat base D and a section having the cross section of a parabolic arch. See FIGS. 1–3 and column 3, lines 36–43. Ribs 22 and 24 are shown on the outside.

U.S. Pat. No. 4,523,613 discloses a drain conduit which includes a base B of porous material such as netting or mesh, and a top wall A formed of two layers 60 and 62 of polyethylene with filler materials. The base and top wall are connected at their edges as illustrated in FIGS. 1 and 2. Apertures 50 at the apex and 52, 54 at the side walls are included as shown in FIG. 1. The side walls are also corrugated.

U.S. Pat. No. 4,650,367 in the FIG. 10 construction discloses an extruded plastic conduit 61 of relatively low profile for use as a roadway underdrain. The conduit includes perforations 66 and interior vertical reinforcing walls 62 and 63. See column 12, lines 4–26. The use of high density polyethylene is discussed in column 13, lines 18–37.

U.S. Pat. No. 4,995,759 discloses a ground drainage system that utilizes a plurality of corrugated tubes oriented in a side-by-side linear fashion with respect to each other by tear portions 19 as shown in FIGS. 2–5. For drainage use, the tubes may be arranged vertically or horizontally as suggested in the paragraph bridging columns 6 and 7.

U.S. Pat. No. 5,087,151 discloses the use of high density polyethylene arch-shaped galleries in drain fields. See column 6, lines 16–18. FIGS. 12–14 show two galleries 10 and 10A with means for coupling the two together. The end wall 28 of gallery 10 is cut off so that rib 18 can be placed over rib 18A' of lesser height on gallery 10A as described in column 5, lines 48–65.

U.S. Pat. No. 5,720,577 discloses a culvert formed from a plurality of corrugated sections 22 with outer reinforcing ribs 24 and 26. See FIG. 1. The ends of the sections 22 are supported in receiving channels 32 over footing pads 28 and 30 as shown in FIGS. 2A and 2B. See column 3, lines 45–65.

The field of search included class 138, subclasses 111, 168 and 173; and class 405, subclasses 43, 48, 49, 124 and 126. Examiner Dennis Taylor was also consulted.

SUMMARY OF THE INVENTION

The invention features a field drain panel that has a low profile drainage panel manufactured from high molecular weight polyethylene. The field drain panel is installed using a unique interlocking overlapping rib method. No separate end plates are required.

The field drain panel is the most versatile of any innovative septic products currently available in the marketplace.

It is produced with a standard of four attached elongated arch-shaped channels approximately one foot wide each, for a total width of four feet. It is also available in one foot, two foot and three foot widths. Any of the four widths may be practical in a number of specific situations. The field drain panel may be used to design many lines having narrow trenches, typically separated by respective minimum separation or wider trenches (up to four feet) installed because of limited area of installation.

The field drain panel is only 8.5 inches high and requires a minimum 6 inches of backfill cover to attain (H-10) residential application traffic demands and requires only 12 inches of backfill cover under pavement to meet (H-20) cargo-carrying multi-wheel vehicle loads.

The field drain panel is also capable of being shortened by trimming with a hand saw by the contractor on the job site. The lay-up length of eight feet can be shortened at any of the twenty-one four inch increments.

Contractors, designers and regulatory agencies have stated that they believe there is a need for such a product. With situations of installation of on-site wastewater treatment systems in areas of higher restrictive horizon, such as seasonal high water or bedrock that would prevent one from going too deep, the field drain panel is a logical choice.

Moreover, since 1989 the inventor has promoted the use of his CONTACTOR™ and RECHARGER™ chambers with a covering of specified geosynthetic filter fabric. The fabric performs its apparent function in the prevention of soil intrusion into the chamber. However, the main advantage of the fabric is to promote a high degree of effluent/soil interface. Over 75% of the fabric is directly exposed to effluent.

However, the field drain panel may be used in place of the CONTACTOR™ and RECHARGER™ chambers for obtaining even better results. When the field drain panel of the present invention is used with two to four channels wide, it is only necessary to cover the outside chambers (i.e. those in contact with the interfacing soil sidewall) with fabric. Likewise, when installed-side-by-side in clustered beds, only the outside chambers need to be covered with fabric. In beds, only the bottom (primary) infiltrative surface is serviced with no effective sidewall serviced within the chamber clusters.

The field drain panel promotes over 80% soil/effluent interface on the primary bottom area and adjacent sidewall to soil area.

Other objects of the invention will in part be obvious and will in part appear hereinafter.

The invention accordingly comprises the features of construction, combination of elements, and arrangement of parts which will be exemplified in the construction hereinafter set forth, and the scope of the invention will be indicated in the claims.

A DESCRIPTION OF THE DRAWING

For a fuller understanding of the nature and objects of the invention, reference should be made to the following detailed description taken in connection with the accompanying drawings, not in scale, in which:

FIGS. 7–14 show diagrams of four different models of field drain panels having four elongated chambers.

FIG. 39, including FIGS. 39(*a*), (*b*), (*c*), (*d*) show diagrams in more detail a field drain C-1 chamber like that shown in FIGS. 15–22.

Figure 1:
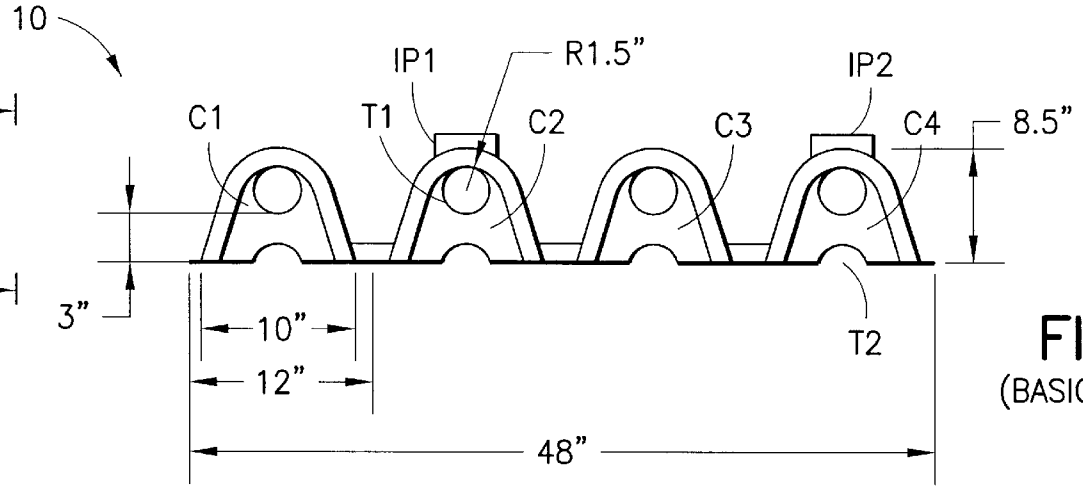
FIG. 1 is a diagram from a first direction of a basic configuration of a field drain panel that is the subject matter of the present application.
Figure 40:
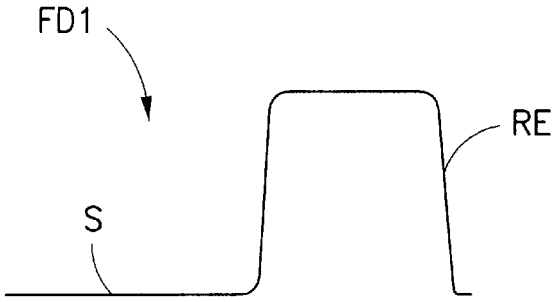

FIG. 40 shows a diagram of a transverse strengthening rib R1, R2, . . . , R22 and RE shown in FIG. 1.

Figure 41:
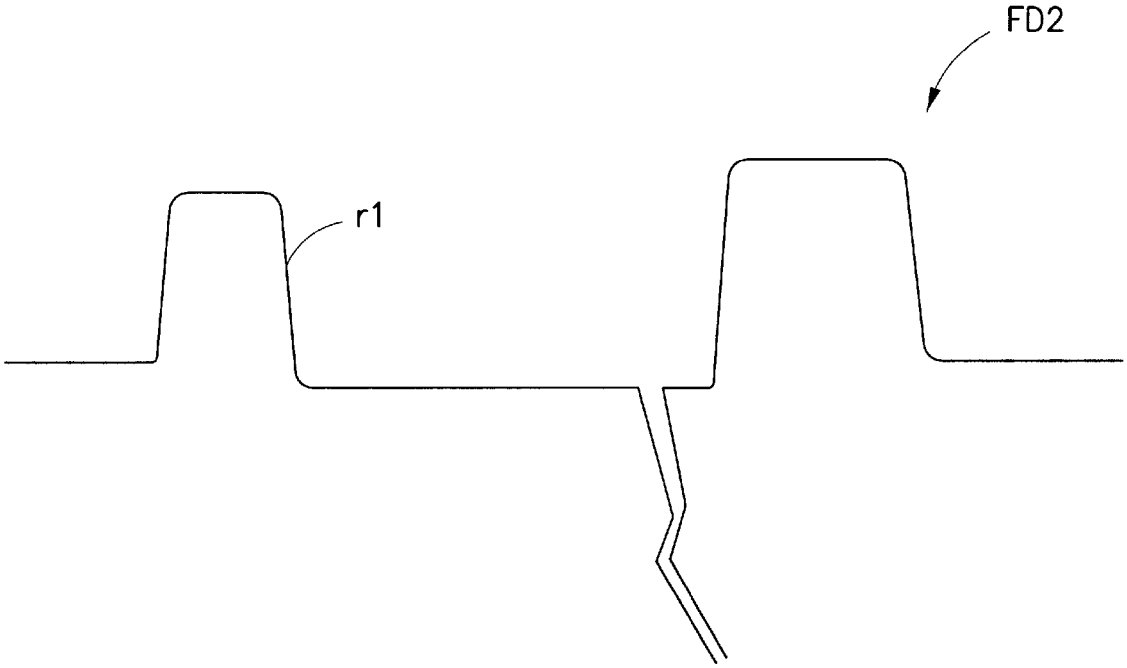
Figure 42:
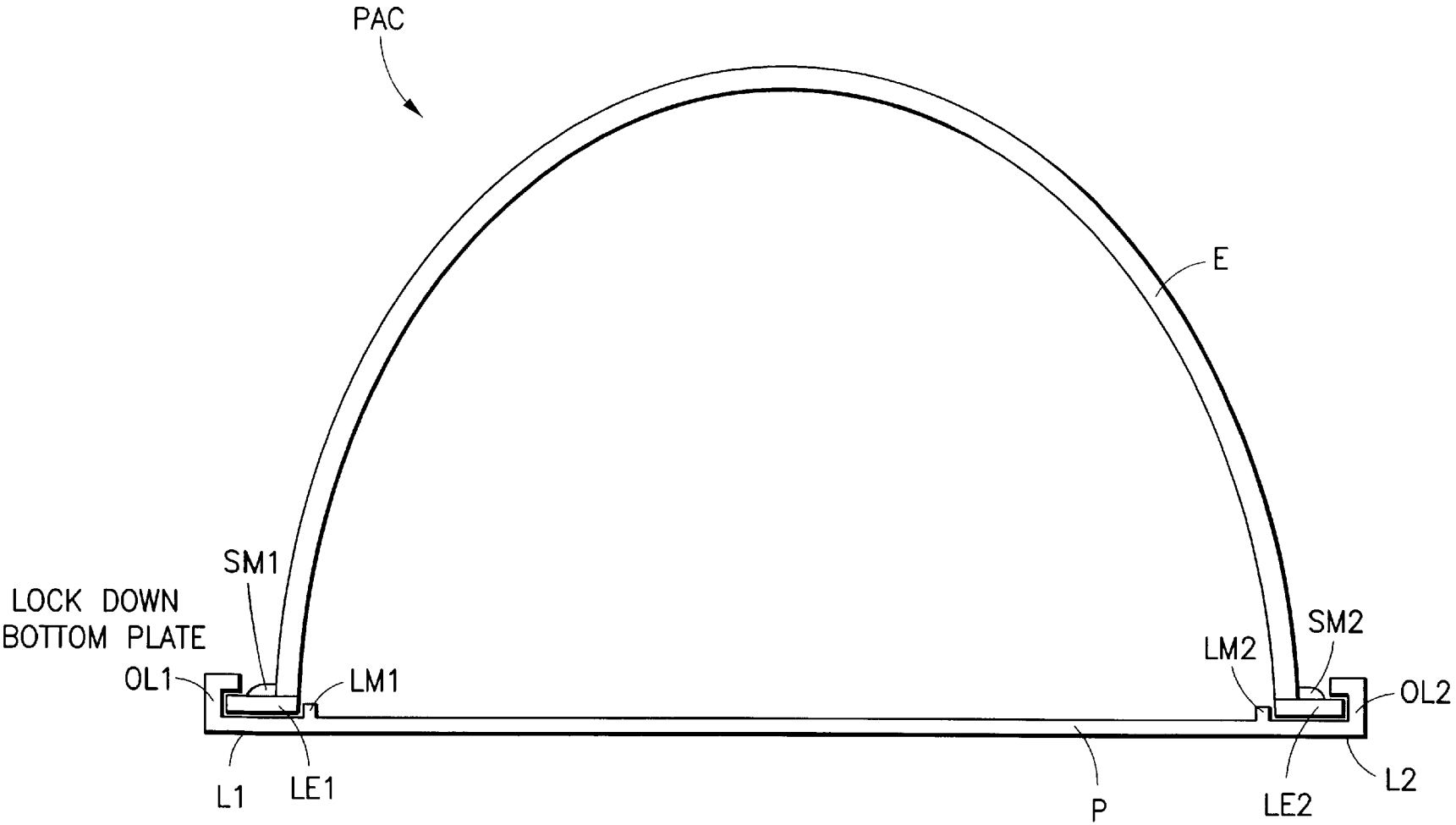
Figure 43:
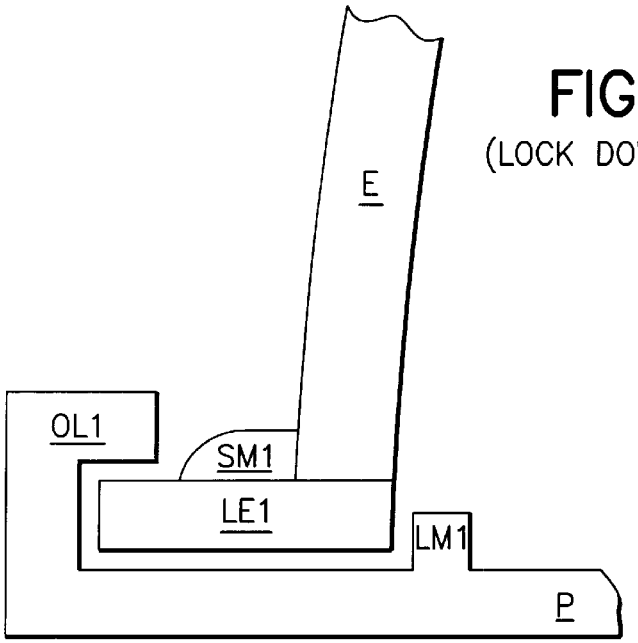
Figure 44:
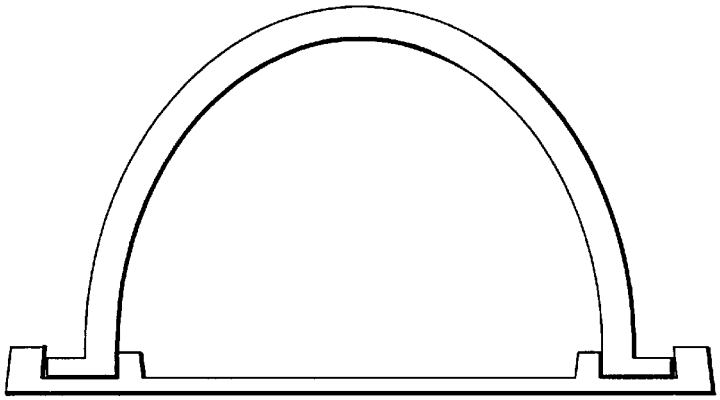
Figure 45:
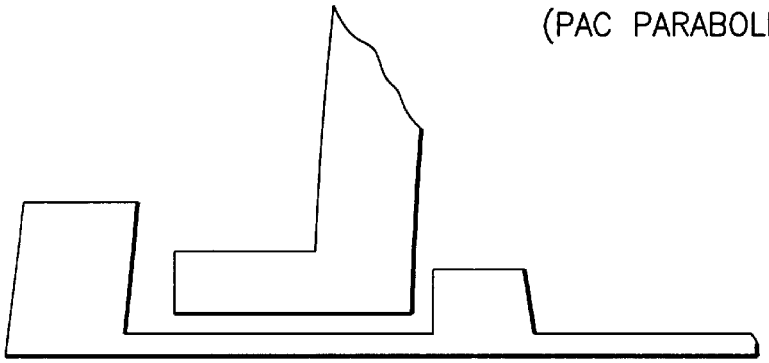

FIG. 41 shows a diagram of either of a smaller transverse strengthening end rib r1, or a smaller transverse strengthening intermediate rib r2 shown in FIG. 1.

FIGS. 42–45 show a diagram of a parabolic arch conduit generally indicated as PAc.

Figure 46:
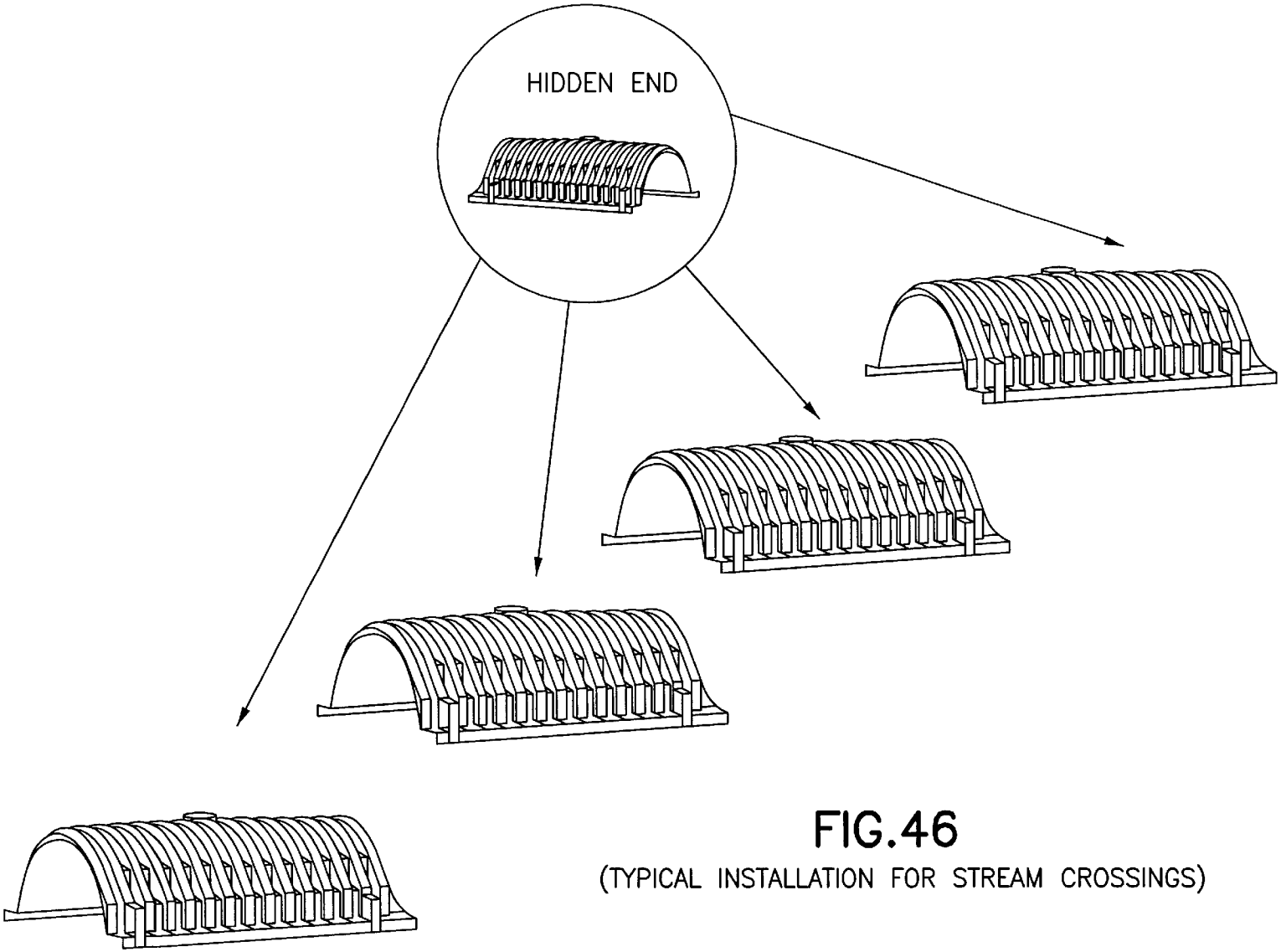

FIG. 46 shows a diagram of a typical installation for stream crossings.

Figure 47:
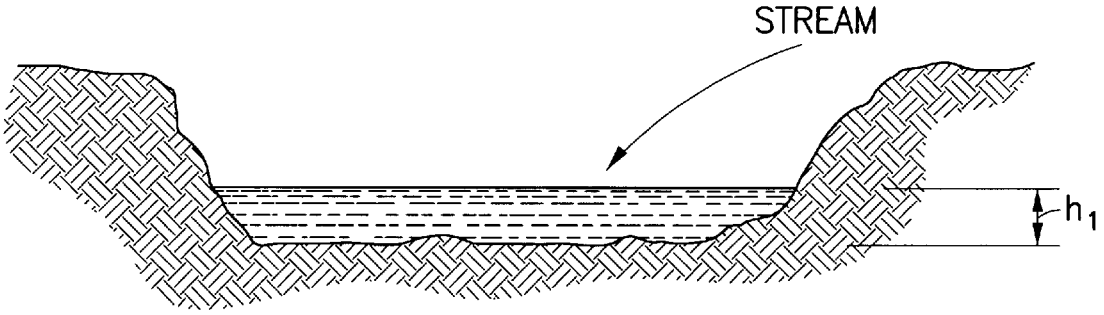
Figure 48:
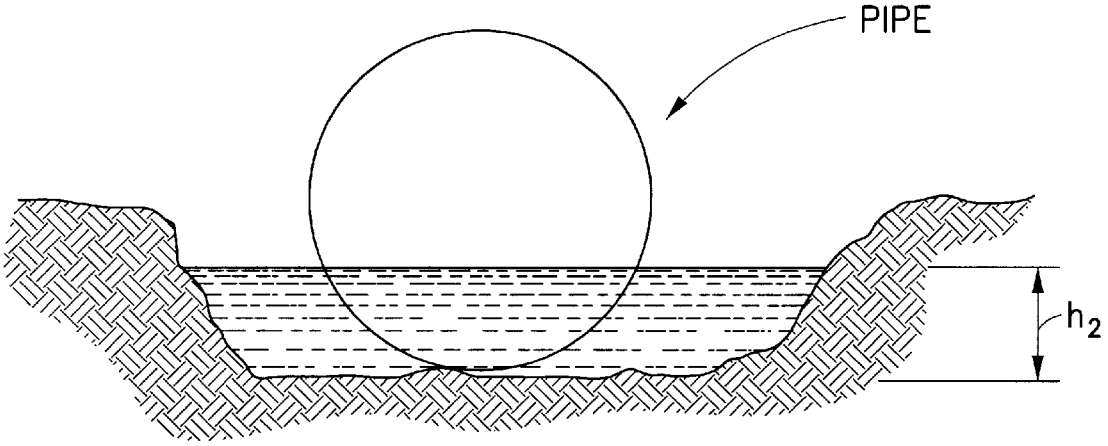
Figure 49:
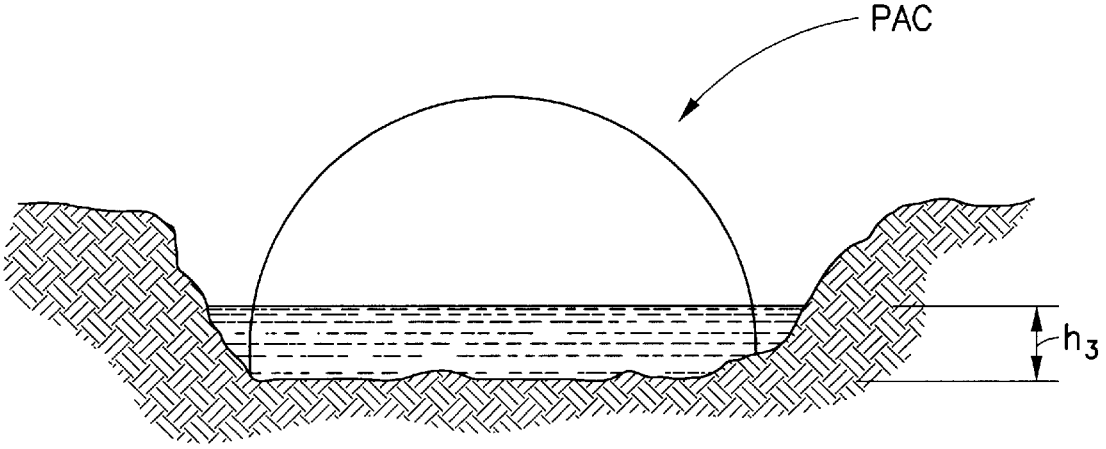

FIGS. 47–49 show a diagram of why a PAC installation shown in FIG. 46 is effective for stream crossings.

FIG. 50 shows a chart showing the calculations of effective interface display of the ratings for one to four channels used in a trench configuration for full load capacity to the top of each arch.

FIG. 51 shows a comparison of effective interface of field drain panels to equal width of pipe and stone trench.

Figure 2:
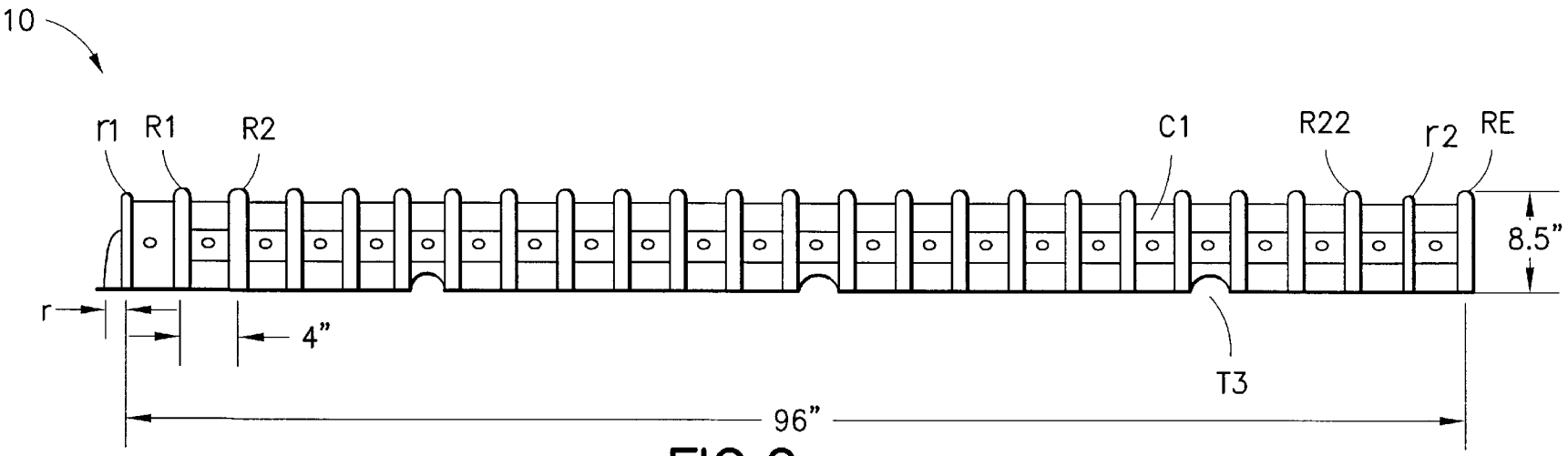
FIG. 2 is a diagram of one elongated chamber from the basic configuration of the field drain panel in FIG. 1 along lines 2—2 that is the subject matter of the present application.

FIG. 52, including FIGS. 52(*a*), (*b*), (*c*), (*d*), shows diagrams of an embodiment of the invention having a plurality of lateral transfer tunnels similar to that shown in FIGS. 2 and 39(*a*).

BEST MODE FOR CARRYING OUT THE INVENTION

General Description of the Invention

In its broadest sense, the present invention features a first molded polymer field drain panel made from a moldable polymer sheet material and having an elongated chamber with an arched-shape, a first end, a second end and transverse strengthening ribs protruding outwardly therebetween.

The elongated chamber has a smaller transverse strengthening end rib, a transverse strengthening end rib and a smaller transverse strengthening intermediate rib.

The smaller transverse strengthening end rib is molded at the first end and shaped for being embracingly overlapped by a corresponding transverse strengthening end rib of a corresponding elongated chamber of a second molded polymer field drain panel.

The transverse strengthening end rib is molded at the second end for overlapping a corresponding smaller transverse strengthening end rib of the corresponding elongated chamber of the second adjoining molded polymer field drain panel.

The smaller transverse strengthening intermediate rib may be molded between any two transverse strengthening ribs with respect to the first end and the second end of the first molded polymer field drain panel for being embracingly overlapped by the corresponding transverse strengthening end rib of the corresponding elongated chamber of the second field drain panel upon severing removal of at least the transverse strengthening end rib that is molded at the second end of the first molded polymer field drain panel.

In one embodiment, the first end is a closed end; the second end is an open end; the smaller transverse strengthening intermediate rib is molded as a second-to-last transverse strengthening rib molded next to the transverse strengthening end rib that is molded at the second end.

With such a construction, the first molded polymer field drain panel is reversible for either connecting its open end to a corresponding open end of a second molded polymer field drain panel upon severing removal of at least the transverse strengthening end rib of one of the molded polymer field drain panel, or for connecting its open end to a corresponding closed end of the second molded polymer field drain panel.

Detailed Description of the Invention

Referring now to FIGS. 1–5, a field drain panel is shown having a versatile low profile 8½ inch high chamber system available in various configurations.

FIG. 1 shows a basic configuration of the field drain panel generally indicated as 10, having four elongated chambers having a total width of 48 inches. Each elongated chamber C1, C2, C3, C4 has an outer width of about 12 inches, an inner width of about 10 inches, and a height of 8.5 inches. Each elongated chamber C1, C2, C3, C4 has four upper circular transfer openings, one of which is labelled T1. Each upper circular transfer opening T1 has a radius of 1.5 inches, for forming a width of 3 inches for fitting PVC pipe. Each elongated chamber C1, C2, C3, C4 has four lower semi-circular transfer openings, one of which is labelled T2. The second and fourth elongated chambers have one or more inspection or access portals IP1, IP2.

As shown in FIG. 2, the elongated chamber C1 has transverse strengthening ribs R1, R2, . . . , R22, a smaller transverse strengthening end rib r1, a smaller transverse strengthening intermediate rib r2, and a transverse strengthening end rib RE. The elongated chamber C1 also has three lateral transfer tunnels or side transfer openings, one of which is labelled T3. The lateral transfer tunnels for allowing effluent to flow from the sides, as well as for flexing the field drain panel to contour it to the terrain. As shown, the elongated chamber C1 has a length of 96 inches.

Figure 4:
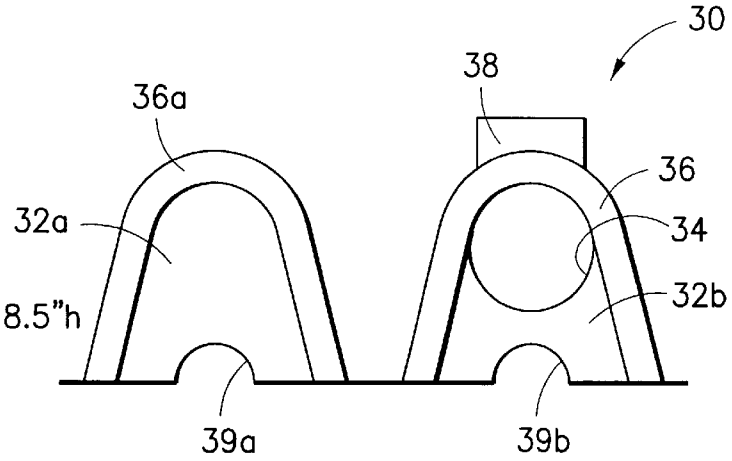
FIGS. 3–6 show diagrams of four different field drain panel configurations.
Figure 3:
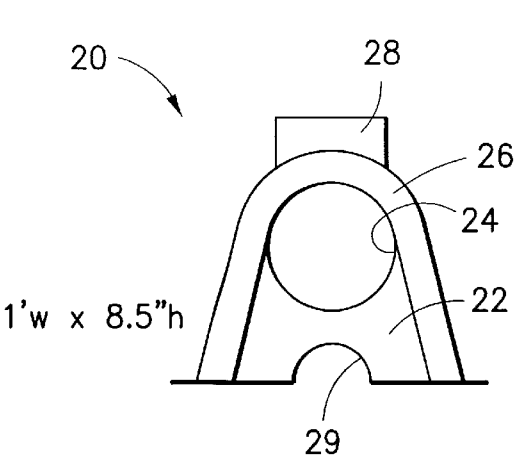
Figure 6:
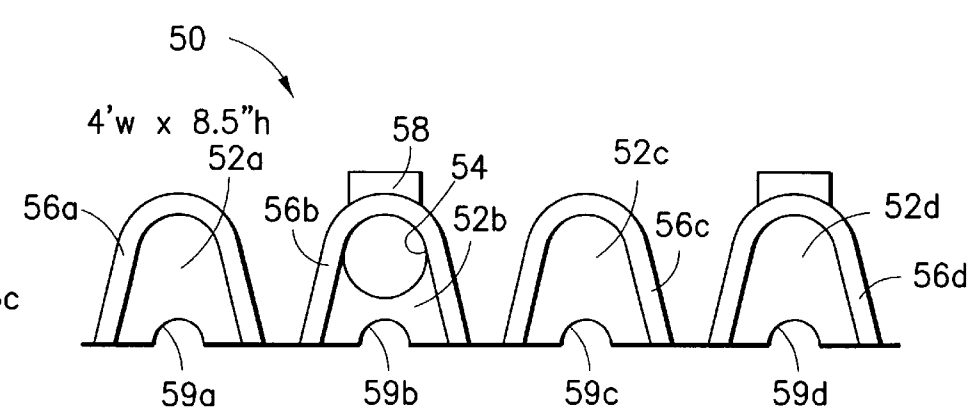
Figure 5:
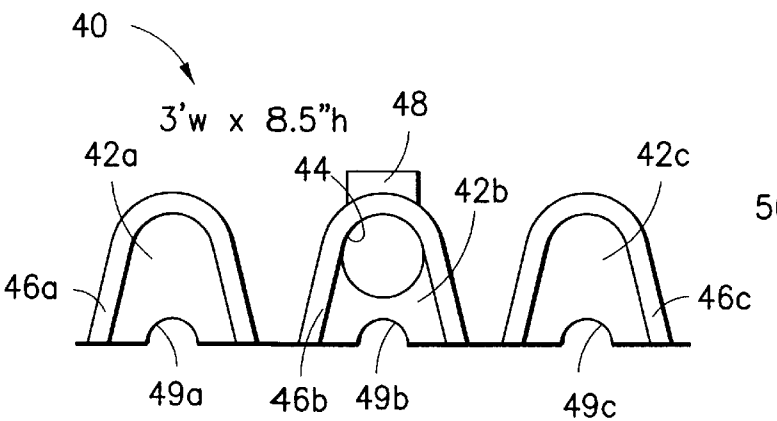

FIGS. 3–6 show diagrams of four different field drain panel configurations. FIG. 3 shows a first configuration having a field drain panel 20 with a single elongated arch-shaped chamber 22 similar to that shown in FIG. 1, having a transfer opening 24, a transverse strengthening end rib 26, one inspection or access portal 28 and a lower semi-circular transfer opening 29. FIG. 4 shows a second configuration having a field drain panel 20 with two elongated chambers similar 32*a,* 32*b* to that shown in FIG. 2 that are molded adjacent and substantially parallel to one another, having a transfer opening 34, transverse strengthening end ribs 36*a,* 36*b,* one inspection or access portal 38 and lower semi-circular transfer openings 39*a,* 39*b.* FIG. 5 shows a third configuration having a field drain panel 40 with three elongated chambers 42*a,* 42*b,* 42*c* similar to that shown in FIG. 2 that are molded adjacent and substantially parallel to one another, having a transfer opening 44, transverse strengthening end ribs 46*a,* 46*b,* 46*c,* one inspection or access portal 48 and lower semi-circular transfer openings 49*a,* 49*b,* 49*c.* FIG. 6 shows a fourth configuration having a field drain panel 50 with four elongated chambers 52*a,* 52*b,* 52*c,* 52*d* similar to that shown in FIG. 2 that are molded adjacent and substantially parallel to one another, having a transfer opening 54, transverse strengthening end ribs 56*a,* 56*b,* 56*c,* 56*d,* one inspection or access portal 58 and lower semi-circular transfer openings 59*a,* 59*b,* 59*c,* 59*d.* The scope of the invention is not intended to the inspection or access portal, or the transfer opening, being located on any particular chamber, or any particular dimensionality of the field drain panel.

FIGS. 7–14 show diagrams of four different models of field drain panels having four elongated chambers, which are not described in detail. The models related to the different ways that the field drain panel is trimmed by sawing or cutting off a portion thereof to build a field drain.

FIGS. 7–8 show a front and back diagram of a model "S" starter field drain panel having a large front rib, a back small rib, a front wall with a starter 4.5 inch transfer opening, back walls with respective upper transfer openings, and one or more lower arch openings. The starter transfer opening allows transfer of effluent for a starter.

FIGS. 9–10 show a front and back diagram of a model "I" middle field drain panel having a large front rib, a back small rib, open fronts, back walls with respective 3.0 inch upper transfer openings, and one or more lower arch openings.

FIGS. 11–12 show a front and back diagram of a model "E" end field drain panel having a large front rib, a back small rib, open fronts, and closed end back walls. The model "E" end field drain panel is formed by trimming at a small rib.

FIGS. 13–14 show a front and back diagram of a model "R" field drain panel having a large front rib, a back small rib, a front wall with an end 4.5 inch transfer opening, and closed back walls.

Single Chamber Field Drain Panel

FIGS. 15–22 show diagrams of four different models of field drain panels having a single elongated chamber.

Figure 15:
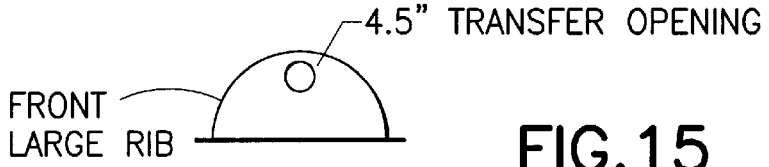
FIGS. 15–22 show diagrams of four different models of field drain panels having a single elongated chamber.
Figure 16:
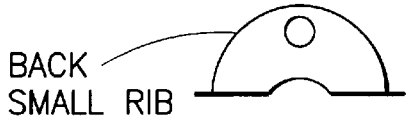

FIGS. 15–16 show a front and back diagram of a model "S" starter field drain panel having a front large rib, a back small rib, front and back walls with a respective 4.5 inch upper transfer opening, and a back arched opening.

Figure 17:
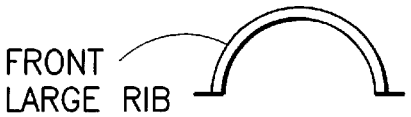
Figure 18:
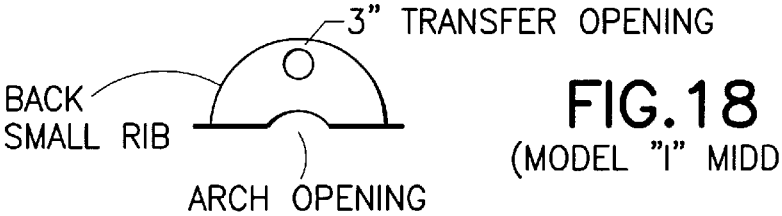

FIGS. 17–18 show a front and back diagram of a model "I" middle field drain panel having a front large rib, a back small rib, a back wall with a 3.0 inch upper transfer opening, and a back arched opening.

Figure 19:
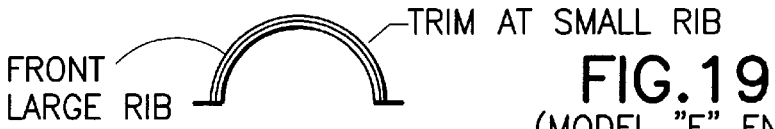
Figure 20:
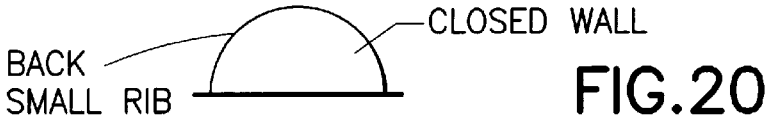

FIGS. 19–20 show a front and back diagram of a model "E" end field drain panel having a front large rib, a back small rib, and a closed back wall. The model "E" end field drain panel is formed by trimming at a small rib.

Figure 21:
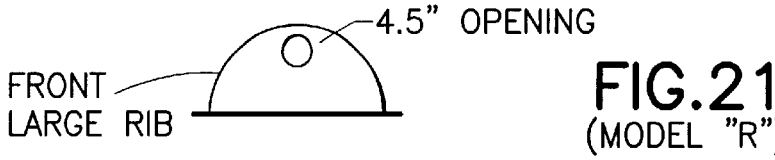
Figure 22:
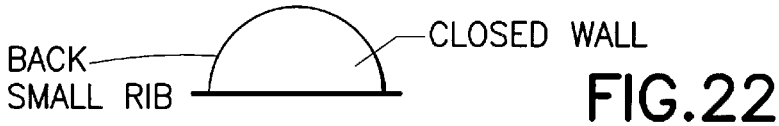

FIGS. 21–22 show a front and back diagram of a model "R" field drain panel having a front large rib, a back small rib, a front wall with a 4.5 inch opening and a closed back wall.

Two Chamber Field Drain Panels

FIGS. 23–30 show diagrams of four different models of field drain panels having two elongated chambers.

Figure 23:
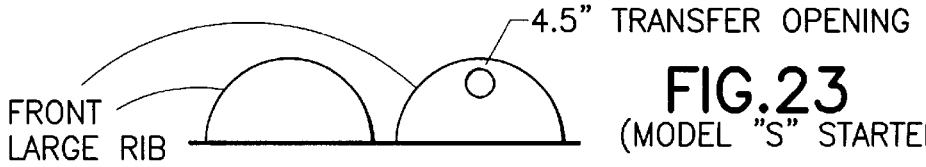
FIGS. 23–30 show diagrams of four different models of field drain panels having two elongated chambers.
Figure 24:
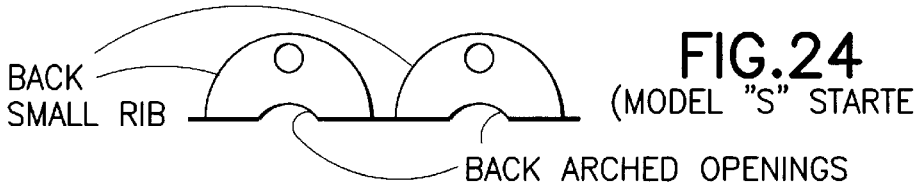

FIGS. 23–24 show a front and back diagram of a model "S" starter field drain panel having two front large ribs, two back small ribs, a front wall with a 4.5 inch upper transfer opening, back walls with 4.5 inch upper transfer openings, and back arched openings.

Figure 25:
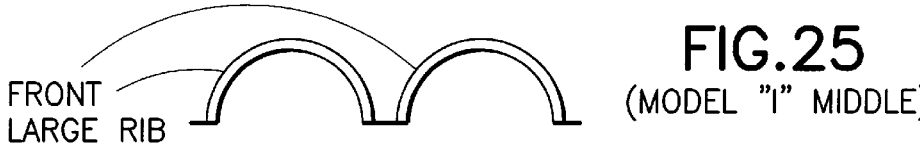
Figure 26:
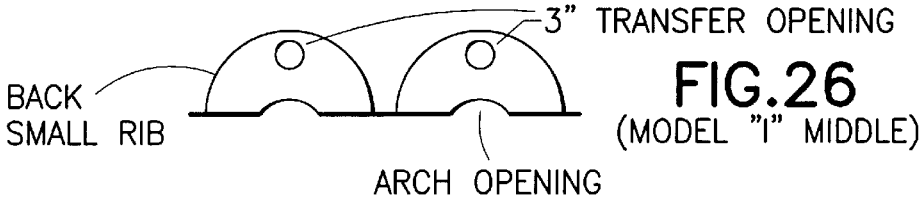

FIGS. 25–26 show a front and back diagram of a model "I" middle field drain panel having two front large ribs, two back small ribs, back walls with 3.0 inch upper transfer openings, and back arched openings.

Figure 27:
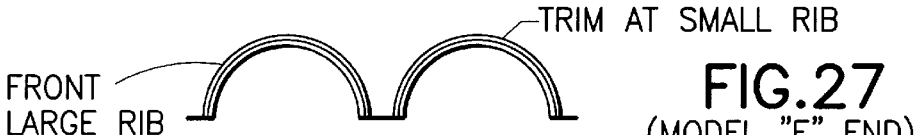
Figure 28:
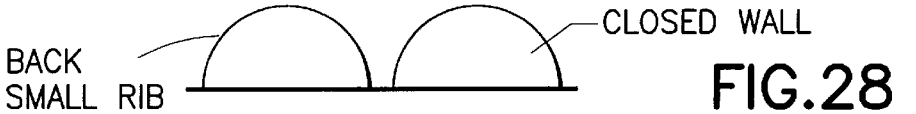

FIGS. 27–28 show a front and back diagrams of a model "E" end field drain panel having two front large ribs, two back small ribs, and closed back walls. The model "E" end field drain panel is formed by trimming at a small rib.

Figure 29:
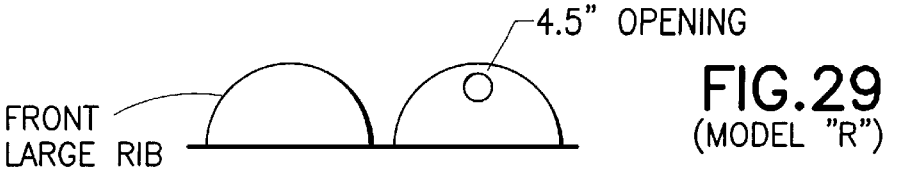
Figure 30:
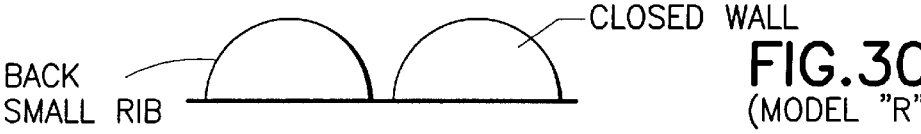

FIGS. 29–30 show a front and back view of a model "R" field drain panel having two front large ribs, two back small ribs, a front wall with a 4.5 inch opening, and closed back walls.

Three Chamber Field Drain Panels

FIGS. 31–38 show diagrams four different models of field drain panels having three elongated chambers.

Figures 31, 32, 33, 34, 35, 36, 37, 38:
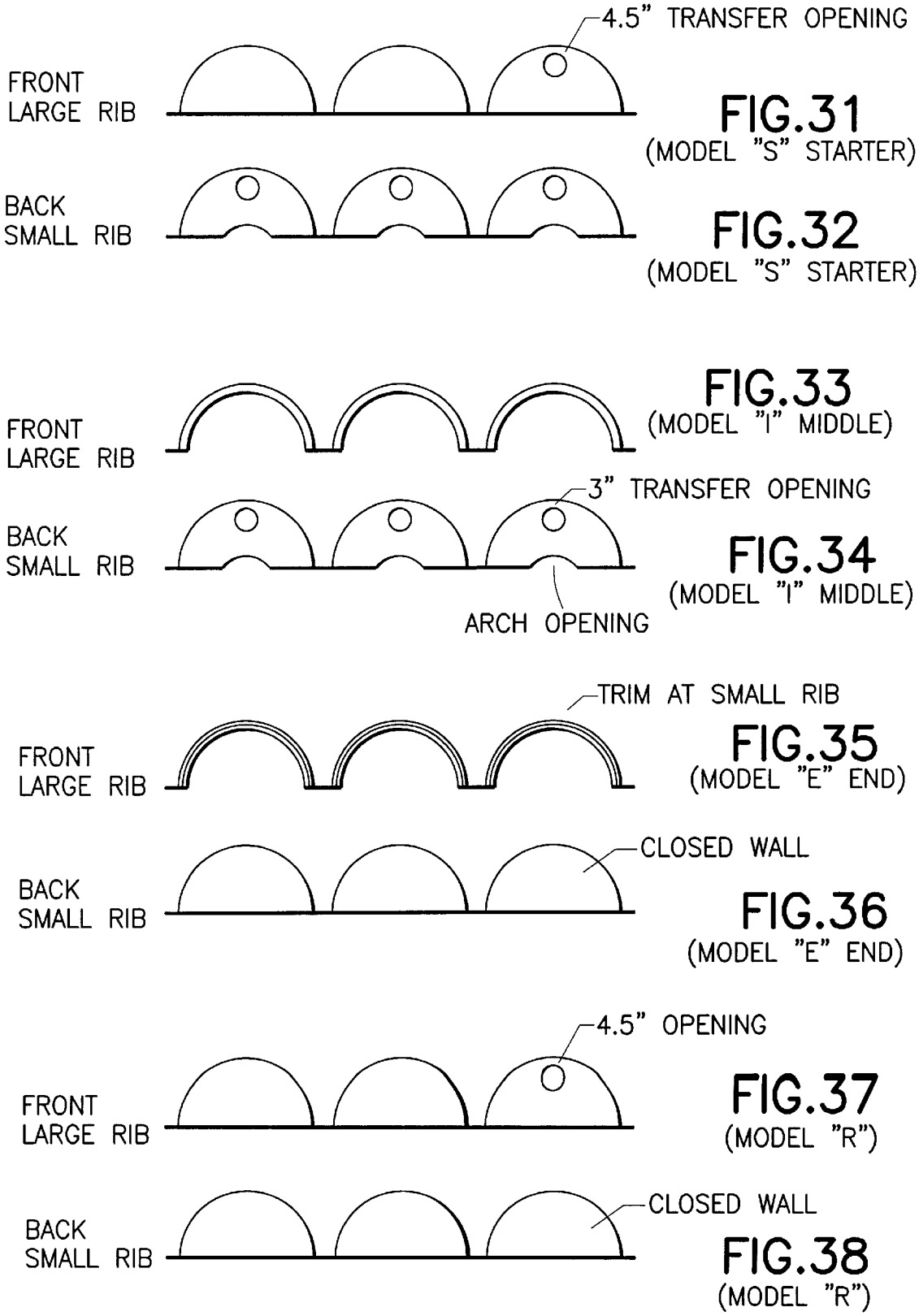
FIGS. 31–38 show diagrams of four different models of field drain panels having three elongated chambers.

FIGS. 31–32 show a front and back view of a model "S" starter field drain panel having three front large ribs, three back small ribs, a front wall with a 4.5 inch upper transfer opening, back walls with 4.5 inch upper transfer openings, and back arched openings.

FIGS. 33–34 show a front and back view of a model "I" middle field drain panel having three front large ribs, three back small ribs, back walls with 3.0 inch upper transfer openings, and back arched openings.

FIGS. 35–36 show a front and back view of a model "E" end field drain panel having three front large ribs, three back small ribs, and closed back walls. The model "E" end field drain panel is formed by trimming at a small rib.

FIGS. 37–38 show a front and back view of a model "R" field drain panel having three front large ribs, three back small ribs, a front wall with a 4.5 inch opening, and closed back walls.

FIG. 39, including FIGS. 39(*a*), (*b*), (*c*) and (*d*), show in more detail a field drain chamber like that shown in FIGS. 15–22. FIG. 39(*a*) is a side view of the elongated chamber. FIG. 39(*b*) is a top view of the elongated chamber. FIG. 39(*c*) shows a diagram of a cross-sectional looking from right-to-left on the paper for a respective model R, model S+I or model E. FIG. 39(*d*) shows a diagram of a cross-sectional looking from left-to-right on the paper for a respective model R+S, model I or model E. Similar to that shown in FIG. 1, the elongated chamber has an outer width of about 12 inches, an inner width of about 10 inches, a height of 8.5 inches, and a spacing of 4 inches between the transverse strengthening ribs. Inspection ports are available on every second chamber.

FIG. 40 shows a diagram of either the transverse strengthening rib R1, R2, . . . , R22 or RE shown in FIG. 1 that has a height and width of about 1.0625 inches. FIG. 41 shows a diagram of either the smaller transverse strengthening end rib r1, or the smaller transverse strengthening intermediate rib r2 in FIG. 1, that each of which has a height and width of about 0.075 inches. As shown, the transverse strengthening rib RE has one face formed at a 95 degree angle with respect to the flat surface F. For example, in operation the smaller transverse strengthening end rib r1 of a first molded polymer field drain panel generally indicated as FD1 in FIG. 40 is embracingly overlapped by a corresponding transverse strengthening end rib RE of a corresponding elongated chamber of a second molded polymer field drain panel generally indicated FD2 in FIG. 41.

FIGS. 42–45 show a parabolic arch conduit generally indicated as PAC that includes an elongated chamber E and a lock down plate P. The elongated chamber E has locking edges LE1, LE2, and strengthening members SM1, SM2. The lock down plate P has overlapping latches OL1, OL2, and inner locking members LM1, LM2. Together these features of the PAC cooperate together to lock the elongated chamber E to the lock down plate P.

FIG. 46 shows a typical installation for stream crossings. In operation, each unit fits together with an interlocking rib system. Each unit should be equipped with a lock-down plate P shown in FIGS. 42–45.

FIGS. 47–49 show why a PAC installation for stream crossings shown in FIG. 46 is effective. FIG. 47 shows a stream having a height of h1. FIG. 48 shows a stream having a height of h2 with a pipe therein for a stream crossing. FIG. 49 shows a stream having a height of h3 with a PAC system therein for a stream crossing, and shows an equation that indicates that the velocity of the water in the pipe is greater than the velocity of the stream and the velocity of the water in the PAC. A comparison of FIGS. 48 and 49 shows that the quantity (Q) of the water for the PAC divided by the height of the PAC is greater than the quantity (Q) of the water for the pipe divided by the height of the pipe.

FIG. 50 shows a chart showing the calculations of effective interface display of the ratings for one to four channels used in a trench configuration for full load capacity to the top of each arch.

FIG. 51 shows a comparison of effective interface of field drain panels to equal width of pipe and stone trench.

FIGS. 42–51 show why the PAC is a cost effective alternative to traditional pipe steam crossings. By using the PAC stream crossing, one eliminates: (1) The inevitable erosion of the original bed under a common pipe crossing, (2) costly pavement repair, (3) materials shipping costs for large projects, and (4) other headaches.

FIG. 52(*a*) is a diagram of a top view of a field drain panel 100, and FIG. 52(*b*) is a diagram of a side view of the field drain panel 100. The field drain panel 100 includes an elongated chamber 102 and transverse strengthening ribs 104, 106, 108, 110, 112, 114, . . . , 142. The transverse strengthening rib 104 is an end rib, the transverse strengthening rib 106 is a small intermediate rib, and the transverse strengthening rib 142 is a smaller end rib. The field drain panel 100 includes a plurality of transfer tunnels 150, 152, . . . , 182 for allowing effluent to pass from the field drain panel, as well as for flexing the field drain panel to contour it to the terrain. As shown in FIGS. 52(*a*), (*b*), the transfer tunnels 150, 152, . . . , 182 are spaced at about every five inches. The scope of the invention is not intended to be limited to any particular shape of the transfer tunnels 150, 152, . . . , 182. The field drain panel 100 also includes transfer openings in the front and back wall as shown in FIGS. 52(*c*), (*d*).

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

I claim:

1. A reversible interlocking field drain panel being made from a moldable polymer sheet material and having a first molded polymer field drain panel and means for forming an elongated chamber with an arched-shape, a first end, a second end and a plurality of transverse strengthening ribs protruding outwardly therebetween, the means for forming the elongated chamber comprising:

a smaller transverse strengthening end rib molded at the first end shaped for being embracingly overlapped by a corresponding transverse strengthening end rib of a corresponding elongated chamber of a second molded polymer field drain panel;

a transverse strengthening end rib molded at the second end for overlapping a corresponding smaller transverse strengthening end rib of the corresponding elongated chamber of the second molded polymer field drain panel; and a smaller transverse strengthening intermediate rib molded between any two transverse strengthening ribs with respect to the first end and the second end of the first molded polymer field drain panel for being embracingly overlapped by the corresponding transverse strengthening end rib of the corresponding elongated chamber of the second field drain panel upon severing removal of at least the transverse strengthening end rib that is molded at the second end of the first molded polymer field drain panel.

2. A reversible interlocking field drain panel according to claim 1, wherein the first end is a closed end.

3. A reversible interlocking field drain panel according to claim 2, wherein the closed end has an opening for receiving a transfer tunnel.

4. A reversible interlocking field drain panel according to claim 1, wherein the second end is an open end.

5. A reversible interlocking multi-chamber field drain panel according to claim 1, wherein the smaller transverse strengthening intermediate rib is molded as a second-to-last transverse strengthening rib molded next to the transverse strengthening end rib that is molded at the second end.

6. A reversible interlocking field drain panel according to claim 1, wherein the first end is a closed end;

wherein the second end is an open end;

wherein the smaller transverse strengthening intermediate rib is molded as a second-to-last transverse strengthening rib molded next to the transverse strengthening end rib that is molded at the second end; and wherein the molded polymer field drain panel is reversible either for connecting the open end to a corresponding open end of the adjoining molded polymer field drain panel, or for connecting the open end to a corresponding closed end of the adjoining molded polymer field drain panel.

7. A reversible interlocking field drain panel according to claim 1, wherein the reversible interlocking field drain panel includes a plurality of corresponding means for forming the elongated chamber being molded substantially adjacent and parallel to one another.

8. A reversible interlocking field drain panel according to claim 1, wherein the molded polymer field drain panel includes either two corresponding elongated chambers, three corresponding elongated chambers, or four corresponding elongated chambers being molded adjacent and parallel to one another.

9. A reversible interlocking field drain panel according to claim 1, wherein the molded polymer field drain panel has a low height of about 8.5 inches.

10. A reversible interlocking field drain panel according to claim 1, wherein the molded polymer field drain panel requires only a minimum of six inches of backfill cover to meet residential lawncare traffic demands.

11. A reversible interlocking field drain panel according to claim 1, wherein the reversible interlocking field drain panel requires only a minimum of twelve inches of backfill cover under pavement to meet cargo-carrying, multi-wheel vehicle loads.

12. A reversible interlocking field drain panel according to claim 1, wherein the means for forming the elongated chamber is about one foot wide and eight feet long.

13. A reversible interlocking field drain panel according to claim 1, wherein the reversible interlocking field drain panel is a molded polymer multi-chamber field drain panel having four corresponding elongated chambers and is dimensioned as four foot wide by eight foot long.

14. A reversible interlocking field drain panel according to claim 1, wherein the means for forming the elongated chamber has an inspection port.

15. A reversible interlocking field drain panel according to claim 14, wherein the height and the width of the smaller transverse strengthening end rib and the smaller transverse strengthening intermediate rib are about 0.75 inches and the height and width of the transverse strengthening end rib and other transverse strengthening ribs are about 1.0625 inches.

16. A reversible interlocking field drain panel according to claim 1, wherein the smaller transverse strengthening end rib and the smaller transverse strengthening intermediate rib have a height and width that are smaller than the height and width of the transverse strengthening end rib.

17. A reversible interlocking field drain panel according to claim 1, wherein the reversible interlocking field drain panel is a low profile drainage panel manufactured from a light-weight high molecular weight polyethylene that is easily cut for trimming the length and width thereof on a job site.

18. A reversible interlocking field drain panel according to claim 1, wherein the reversible interlocking field drain panel has a lower rim having a plurality of transfer tunnels for allowing effluent to pass from the field drain, as well as for flexing the field drain panel to contour it.

19. A reversible interlocking field drain panel according to claim 18, wherein the plurality of transfer tunnels are spaced at about five inches apart.

20. A reversible interlocking field drain panel being made from a moldable polymer sheet material having a first molded polymer field drain panel, comprising:

a plurality of means for forming an elongated chamber;

each of the plurality of means for forming having an arched-shape, a closed end, an open end and a plurality of transverse strengthening ribs protruding outwardly therebetween, having a corresponding size and shape, and being molded substantially adjacent and parallel to one another;

each of the plurality of means for forming the elongated chamber further comprising:

a smaller transverse strengthening end rib molded at the closed end and shaped for being embracingly overlapped by a corresponding transverse strengthening end rib of a corresponding elongated chamber of a second adjoining molded polymer field drain panel;

a transverse strengthening end rib molded at the open end and shaped for overlapping a corresponding smaller transverse strengthening end rib of the corresponding elongated chamber of the second adjoining molded polymer field drain panel; and a smaller transverse strengthening second-to-last rib molded next to the transverse strengthening end rib of the first adjoining field drain panel for being embracingly overlapped by the corresponding transverse strengthening end rib of the corresponding elongated chamber of the second adjoining field drain panel upon removal of at least the transverse strengthening end rib that is molded at the open end of the first adjoining field drain panel.

21. A reversible interlocking field drain panel according to claim 20, wherein the reversible interlocking field drain panel has a low height of about 8.5 inches.

22. A reversible interlocking field drain panel according to claim 20, wherein the reversible interlocking field drain panel requires only a minimum of six inches of backfill cover to meet residential lawncare traffic demands.

23. A reversible interlocking field drain panel according to claim 20, wherein the reversible interlocking field drain panel requires only a minimum of twelve inches of backfill cover under pavement to meet cargo-carrying, multi-wheel vehicle loads.

24. A reversible interlocking field drain panel according to claim 20, wherein each of the means forming the elongated chamber is about one foot wide and eight feet long.

25. A reversible interlocking field drain panel according to claim 20, wherein the reversible interlocking field drain panel includes four corresponding elongated chamber and is dimensioned as four foot wide by eight foot long.

26. A reversible interlocking field drain panel according to claim 20, wherein at least one of the means for forming the elongated chamber has an inspection port.

27. A reversible interlocking field drain panel according to claim 20, wherein the closed end has an opening for receiving a transfer tunnel.

28. A reversible interlocking field drain panel according to claim 20, wherein the smaller transverse strengthening end rib and the smaller transverse strengthening intermediate rib have a height and width that are smaller than the height and width of the transverse strengthening end rib.

29. A reversible interlocking field drain panel according to claim 28, wherein the height and the width of the smaller transverse strengthening end rib and the smaller transverse strengthening intermediate rib are about 0.75 inches and the height and width of the transverse strengthening end rib and other transverse strengthening ribs are about 1.0625 inches.

* * * * *

UNITED STATES PATENT AND TRADEMARK OFFICE

CERTIFICATE OF CORRECTION

PATENT NO. : 6,129,482
DATED : October 10, 2000
INVENTOR(S) : DiTullio

It is certified that error appears in the above-identified patent and that said Letters Patent is hereby corrected as shown below:

Title page, item [76], inventors,
Line 2, delete "Ditullio" and insert -- DiTullio --.

Column 3,
Line 35, delete "PAc" and insert -- PAC --.

Column 7,
Line 38, delete "steam crossings" and insert -- stream crossings --.

Column 10,
Line 39, (claim 25, line 3), delete "elongated chamber" and insert -- elongated chambers --.

Signed and Sealed this

Sixth Day of November, 2001

*Attest:*

Nicholas P. Godici

*Attesting Officer*

NICHOLAS P. GODICI
*Acting Director of the United States Patent and Trademark Office*